US007437092B2

(12) United States Patent
Sugihara

(10) Patent No.: US 7,437,092 B2
(45) Date of Patent: Oct. 14, 2008

(54) IMAGE FORMING DEVICE

(75) Inventor: Tomoyoshi Sugihara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/258,165

(22) Filed: Oct. 26, 2005

(65) Prior Publication Data

US 2007/0092283 A1 Apr. 26, 2007

(51) Int. Cl.
*G03G 15/00* (2006.01)

(52) U.S. Cl. ..... 399/81

(58) Field of Classification Search ..... 399/81, 399/72, 70

See application file for complete search history.

(56) References Cited

U.S. PATENT DOCUMENTS 6,435,690 B1 * 8/2002 Till ..... 362/88
6,975,369 B1 * 12/2005 Burkholder ..... 349/61
2007/0045442 A1 * 3/2007 Chapman et al. ..... 236/94

FOREIGN PATENT DOCUMENTS

JP 08327971 A * 12/1996
JP 2002103755 A * 4/2002
JP 2003304363 A * 10/2003
JP 2004012962 A * 1/2004

* cited by examiner

*Primary Examiner*—David M Gray
*Assistant Examiner*—Erika J. Villaluna
(74) *Attorney, Agent, or Firm*—Global IP Counselors, LLP

(57) ABSTRACT

The device is constituted so that, when a non-processing period continues for more than a predetermined time in a normal mode, in which an image forming process is possible, the image forming device switches to a power saving mode, in which power consumption is reduced, two types of LEDs 8*a* and 8*b* that have display colors that differ from one another being provided, and each light source 8*a* and 8*b* being selectively illuminated by the mode notification means 13 according to the normal mode and the power saving mode.

4 Claims, 5 Drawing Sheets

IMAGE FORMING DEVICE

FIELD OF THE INVENTION

The present invention relates to an image forming device such as a copier, a printer or a facsimile machine; more specifically, it relates to an image forming device allowing an observer to clearly distinguish between a normal mode in which image forming processes are possible, a power saving mode in which power consumption is reduced, and a power source off mode in which the power switch is off.

BACKGROUND INFORMATION

In general, in order to reduce wasteful power consumption, some image forming devices such as copiers, printers, facsimile devices or multi-function machines, are constituted so to be able to switch to a power saving mode if a period in which no processing is performed continues for a predetermined amount of time in a normal mode, in which image forming processes are possible. For instance, when a copier is switched to the power saving mode, processes such as reducing the temperature of the fixing roller are performed.

Conventionally, this type of image forming device is provided with an operation panel for performing various setting operations. Thus, switches for various setting operations, a liquid crystal display unit for verifying setting operations and the like, are located on this operation panel.

In this case, in the prior art, a control process is carried out, in which a backlight light source, consisting of an LED or the like in the liquid crystal display unit that is provided on the control panel, is illuminated in the normal mode, but in the power saving mode, the backlight light source is turned off.

However, when in such a power saving mode, if a control process that turns off a backlight light source in the liquid crystal display unit is performed, it is difficult to distinguish this situation from a situation in which the power switch for the main power source is off. Thus, confusion arises, and the user may be misled into thinking that the power switch is off, and may turn the power switch on and off again, when in reality the device was merely switched to power saving mode.

The present invention was devised in view of the above problem, and an object thereof is to provide an image forming device with better usability than was conventional, by allowing an observer to clearly recognize which state the device is currently in: normal mode, power saving mode or power source off mode.

SUMMARY OF THE INVENTION

The present invention assumes an image forming device constituted so that, when a non-processing period continues for more than a predetermined amount of time in a normal mode, in which an image forming process is possible, the image forming device switches to a power saving mode, in which power consumption is reduced. Then, the present invention comprises a mode notification means for making the display color or display mode of a light source differ according to the normal mode and the power saving mode.

In this case, the mode notification means can have a constitution comprising two types of light sources having display colors that are different from one another, and an illumination drive means for switching between and driving the illumination of the each light source according to the normal mode and the power saving mode.

Alternatively, the mode notification means can have a constitution comprising a single light source and an illumination drive means for switching the display mode of the light source according to the normal mode and the power saving mode. Then, the light source can be used as a backlight for a liquid crystal display unit provided on the control panel.

According to the present invention, as the mode notification means makes the display color or the display mode of the light source differ according to the normal mode, in which an image forming process is possible, and the power saving mode, in which the power consumption is reduced, not only is it possible to clearly distinguish between the normal mode and the power saving mode, but it is also possible for an observer to clearly understand whether or not the power switch is off. Therefore, it is possible to improve usability by eliminating the confusion which was conventional, such as a user being misled into thinking that the power switch is off, and turning the power switch on and off again, when in reality the device was merely switched to power saving mode.

In particular, by switching between and driving the illumination of two types of light sources having display colors that differ from one another according to the normal mode and the power saving mode, the difference between these operating modes can be clearly understood by an observer at a glance, based on the difference in the illumination colors of the light source.

In addition, switching the display mode of the light source according to the normal mode and the power saving mode, can be implemented using a single light source, which is inexpensive.

In addition, when used for a backlight light source for a liquid crystal display unit provided on a control panel, in general, it is generally very easy to determine, simply by looking at the control panel, which is located at a noticeable position, whether the device is the normal mode, the power saving mode or the power source off mode.

DETAILED DESCRIPTION OF THE PREFERRED EMBODIMENTS

Figure 1:
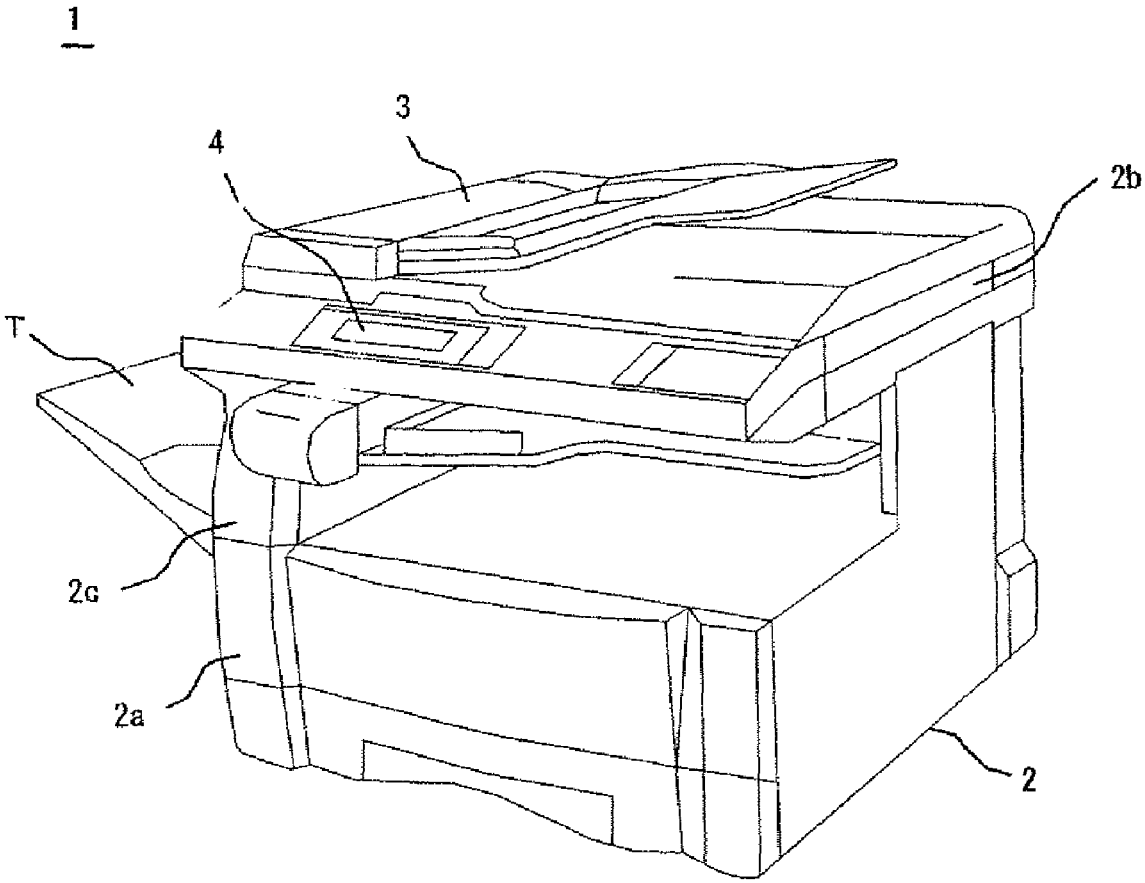
FIG. 1 is a perspective view showing the entirety of a copier, as an image forming device in an embodiment of the present invention.
Figure 2:
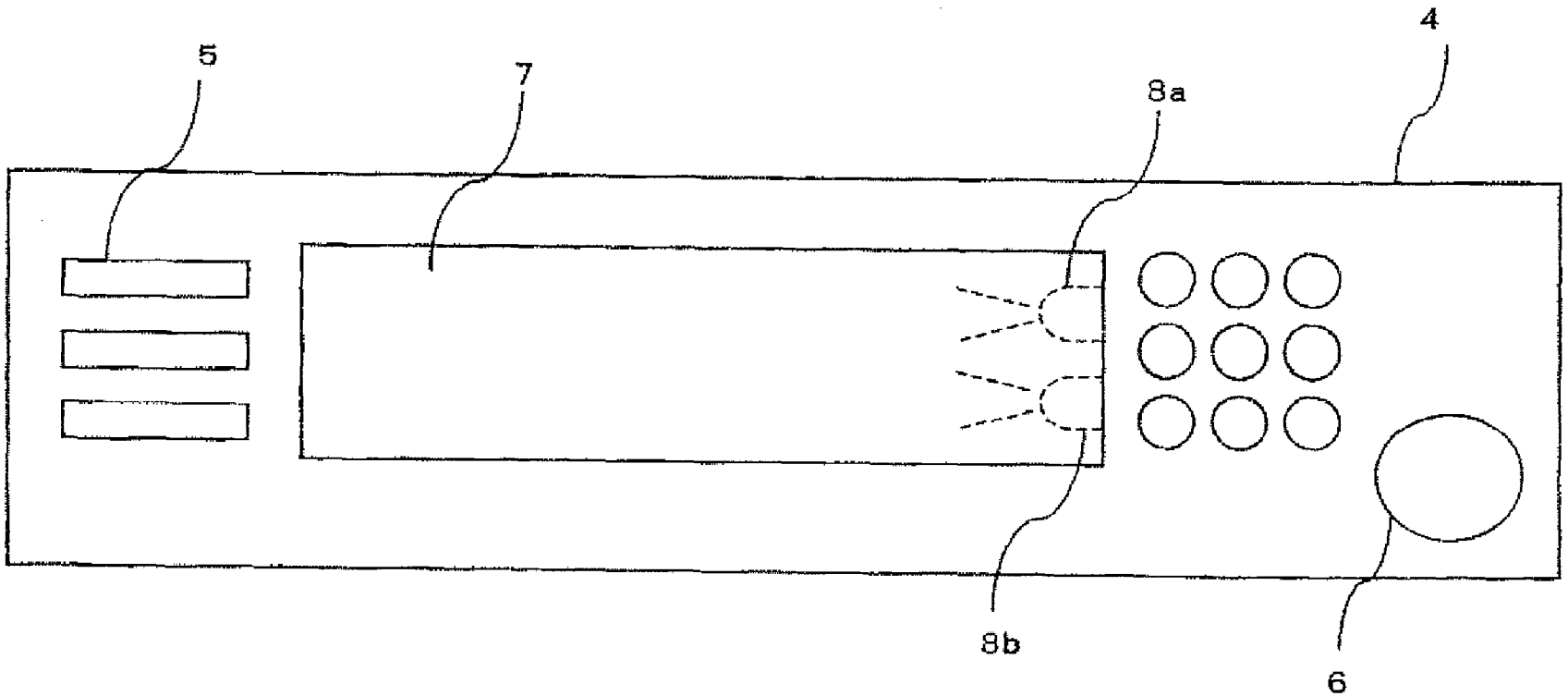
FIG. 2 is a plan view of a control panel in the same copier.

FIG. 1 is a perspective view showing the overall structure of a copier, as an image forming device in one embodiment of the present invention, and FIG. 2 is a plan view of a control panel in the same copier.

In this embodiment, a copier 1 comprises a main body housing 2, this main body housing 2 having a lower housing 2*a*, an upper housing 2*b*, and a connecting housing 2*c* that interconnects both parts 2*a* and 2*b*. Then, a paper tray, a transport mechanism, a transfer mechanism unit, a fixing mechanism unit and the like, which are not shown, are provided in the lower housing 2*a* and the connecting housing 2*c*. In addition, a reading mechanism, which is not shown, for reading a document, and a document feeding device 3 for automatically transporting documents are provided in the upper housing 2*b*, and a control panel 4 is further provided on the front side. In addition, note that T is a sheet receiving tray to which sheets are output after copying.

A switch 5 and a button 6 for various setting operations, a liquid crystal display unit 7 consisting of an LCD for verifying operations and the like, are located on the control panel 4. Then, two types of LEDs 8*a* and 8*b* are provided on the liquid crystal display unit 7 as a backlight light source therefor, having display colors that differ from one another.

That is to say, the LED 8*a*, on one hand, is to be used for normal mode display and, for instance, one having a drive voltage of 5V and emitting white light, is used (hereinafter, this LED 8*a* will be referred to as the normal mode LED). The LED 8*b*, on the other hand, is to be used for power saving mode display and, for instance, one with a drive voltage of 3.3V and emitting green light, is used (hereinafter, this LED 8*b* will be referred to as the power saving mode LED). Thus, the normal mode LED 8*a* and the power saving mode LED 8*b* have different display colors; furthermore, the power saving mode LED 8*b* consumes less power when lit than the normal mode LED 8*a*.

Note that LEDs 8*a* and 8*b* are used as light sources; however, not only LEDs, but also other light sources, such as incandescent lamps, can also be used, so long as the one used for normal mode display and the one used for power saving mode display have different display colors and power consumption is also different for each mode.

Figure 3:
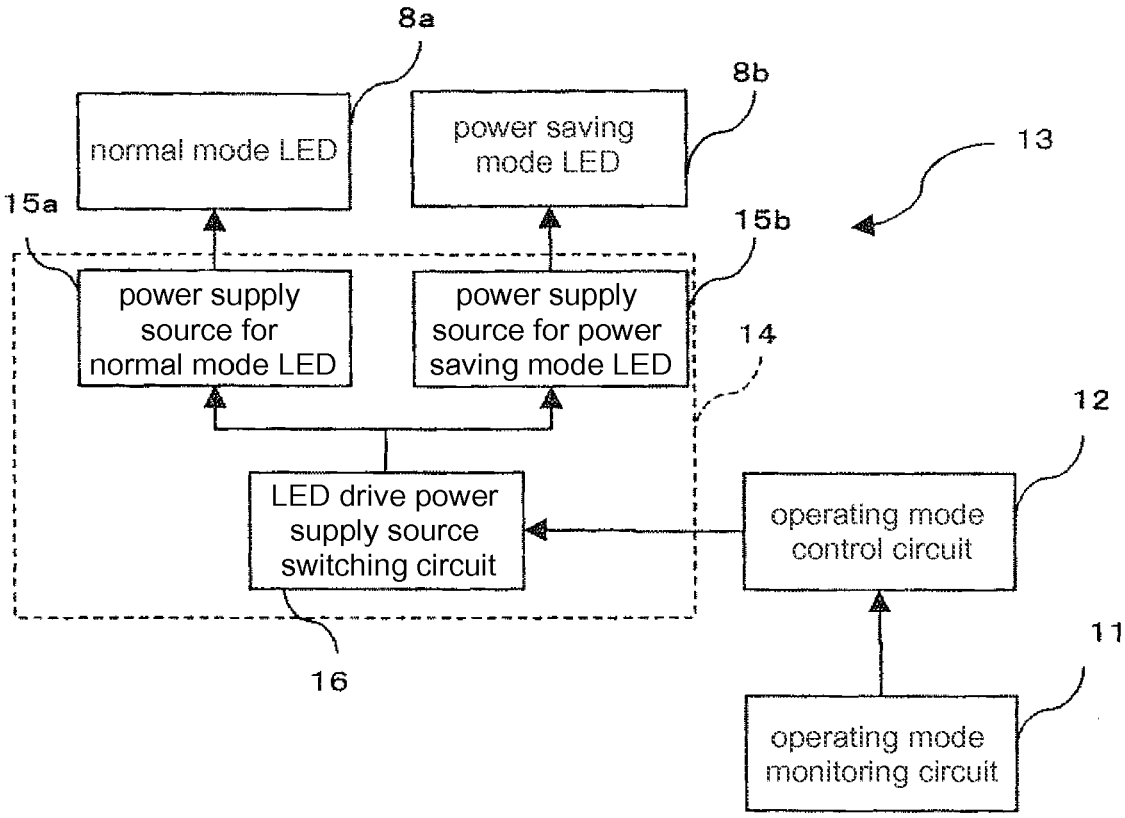
FIG. 3 is a block diagram showing the operating mode switching control system in the same copier.

FIG. 3 is a block diagram showing the operating mode switching control system of this copier.

In this embodiment, an operating mode switching control system comprises an operating mode monitoring circuit 11 for monitoring whether the current device status is the normal mode or the power saving mode, an operating mode control circuit 12 for, based on the monitoring result of this operating mode monitoring circuit 11, switching to the operating state in which the image copy processes are possible when the normal mode is assessed, and switching to the operating state that reduces power consumption, such as by lowering the temperature of the fixing roller, which is not shown, if the power saving mode is assessed, and a mode notification means 13 for external notification of whether the current device state is the normal mode or the power saving mode.

The operating mode monitoring circuit 11 comprises an internal timer or the like, not shown, and sends a trigger signal to the operating mode control circuit 12 to switch to the power saving mode if a non-processing period continues for more than a predetermined amount of time in normal mode.

In addition, the mode notification means 13 consists of the two LEDs 8*a* and 8*b*, and an illumination drive means 14 for switching between and driving each LED 8*a* and 8*b* in the normal mode and the power saving mode. Then, the illumination drive means 14 comprises a power supply source 15*a* for the normal mode LED for lighting the normal mode LED 8*a*, a power supply source 15*b* for the power saving mode LED for lighting the power saving mode LED 8*b*, and an LED drive power supply source switching circuit 16 for selectively switching between the power supply sources 15*a* and 15*b* according to the selection of either the normal mode or the power saving mode by the operating mode control circuit 12.

Figure 4:
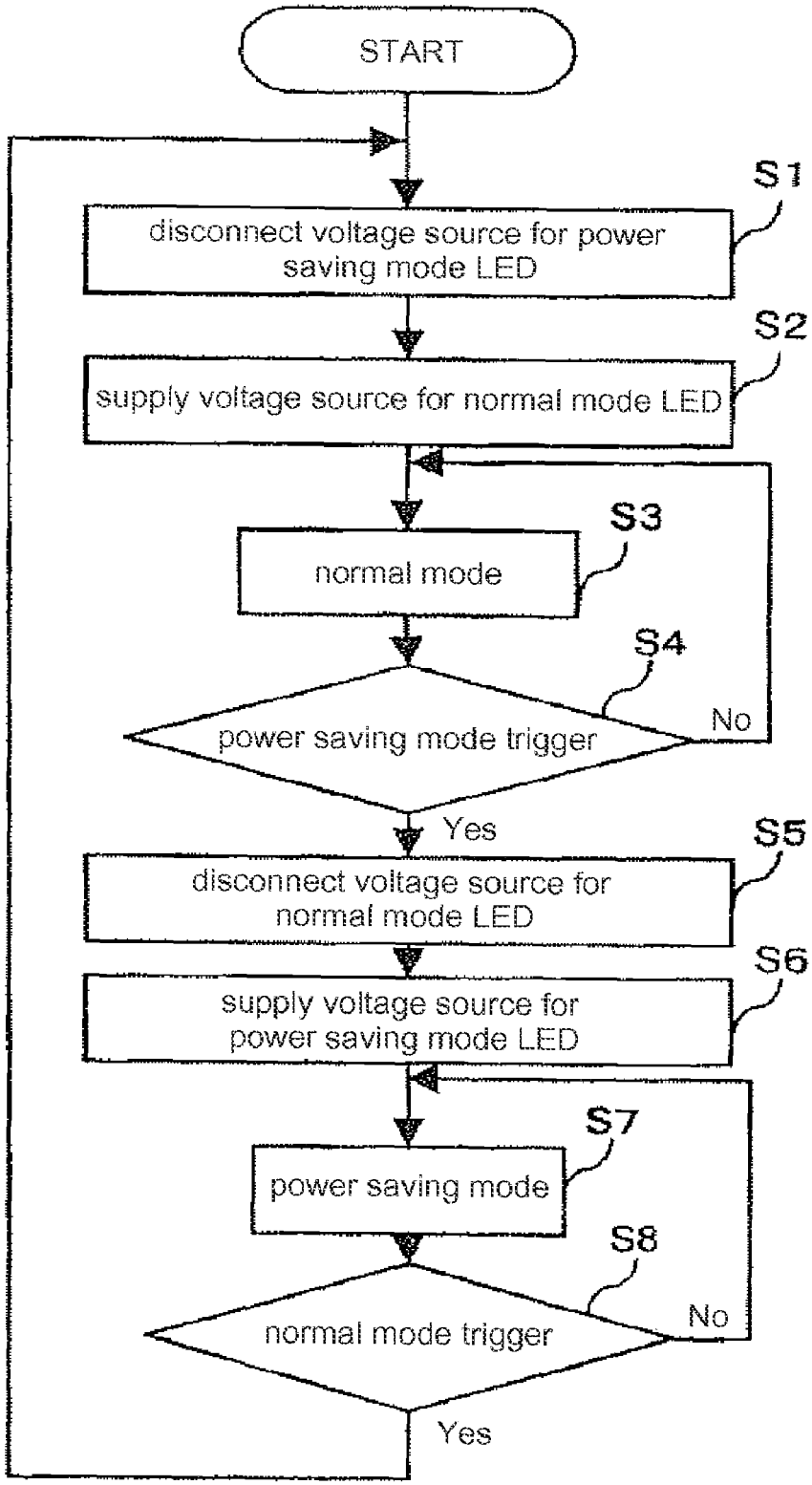
FIG. 4 is a flowchart used to explain the workings of the operating mode switching control system in the copier.

Next, the control operations of the operating mode switching control system shown in FIG. 3 will be explained with reference to the flowchart shown in FIG. 4. Note that, in this figure, the symbol S represents steps.

First, if a power switch, which is not shown, is turned on and the power supply is started, the operating mode monitoring circuit 11 assesses the normal mode, and as the operating mode control circuit 12 is given this assessment result, the operating mode control circuit 12 operates the LED drive power supply source switching circuit 16 so as to disconnect the power supply source 15*b* for the power saving mode LED and selects the power supply source 15*a* for the normal mode LED (step 1).

With this operation, power is supplied from the power supply source 15*a* for the normal mode LED to the normal mode LED 8*a*, so as to light the LED 8*a* which emits white light (step 2). Therefore, suitable brightness for a backlight light source in the liquid crystal display unit 7 of the control panel 4 can be maintained. Simultaneously, the operating mode control circuit 12 switches to the normal mode, which is an operating state in which image copy processing is possible, for instance, by raising the temperature of the fixing roller and maintaining a temperature at which copying is possible (step 3).

In this normal mode, if the non-processing period continues for more than a predetermined amount of time in normal mode, the operating mode monitoring device 11 sends a trigger signal to the operating mode control circuit 12 to switch to the power saving mode (step 4).

In response to the trigger signal input from the operating mode monitoring device 11, the operating mode control circuit 12 operates the LED drive power supply source switching circuit 16 so as to disconnect the power supply source 15*a* for the normal mode LED and selects the power supply source 15*b* for the power saving mode LED (step 5). This causes power saving mode LED power to be supplied from the power supply source 15*b* to the power saving mode LED 8*b*, so as to light the LED 8*b* which emits green light (step 6). Therefore, while the green power saving mode LED 8*b* is lit, the current device status can be recognized as the power saving mode and not the power source off mode. Moreover, in this case, as the power consumption required to drive the power saving mode LED 8*b* is less than that for the normal mode LED 8*a*, this lighting mode is suited to the situation where the power saving mode is in use. Simultaneously, in response to the trigger signal input from the operating mode monitoring device 11, the operating mode control circuit 12 switches to the power saving mode, which is an operating state in which the power consumption is kept low, for instance, by lowering the temperature of the fixing roller and the like (step 7).

In this power saving mode, if a switch 5 or the like on the control panel 4 is operated, the operating mode monitoring device 11 sends a trigger signal to the operating mode control circuit 12 to return from the power saving mode to the normal mode (step 8). In response, the operating mode control circuit 12 returns to step 1, once again lighting the normal mode LED 8*a* as described above, while at the same time, returning the operating state of the device to the normal mode.

Thus, in this embodiment, the normal mode in which image forming processes are possible and the power saving mode in which the power consumption is reduced can be clearly distinguished by an observer based on the difference in the color of light emitted by the two types of LEDs 8*a* and 8*b*. In addition, the difference between the power saving mode and the power source off mode can also be clearly distinguished based on whether or not the power saving mode LED 8*b* is lit. Therefore, usability can be improved by eliminating confusion which was conventional, such as a user being misled into thinking that the power switch is off, and turning the power switch on and off again, when in reality the device was merely switched to power saving mode. Furthermore, as reduced power consumption suffices to drive the power saving mode LED 8*b* as compared to the normal mode LED 8*a*, the embodiment is also suited to the situation in which the power saving mode is in use.

Figure 5:
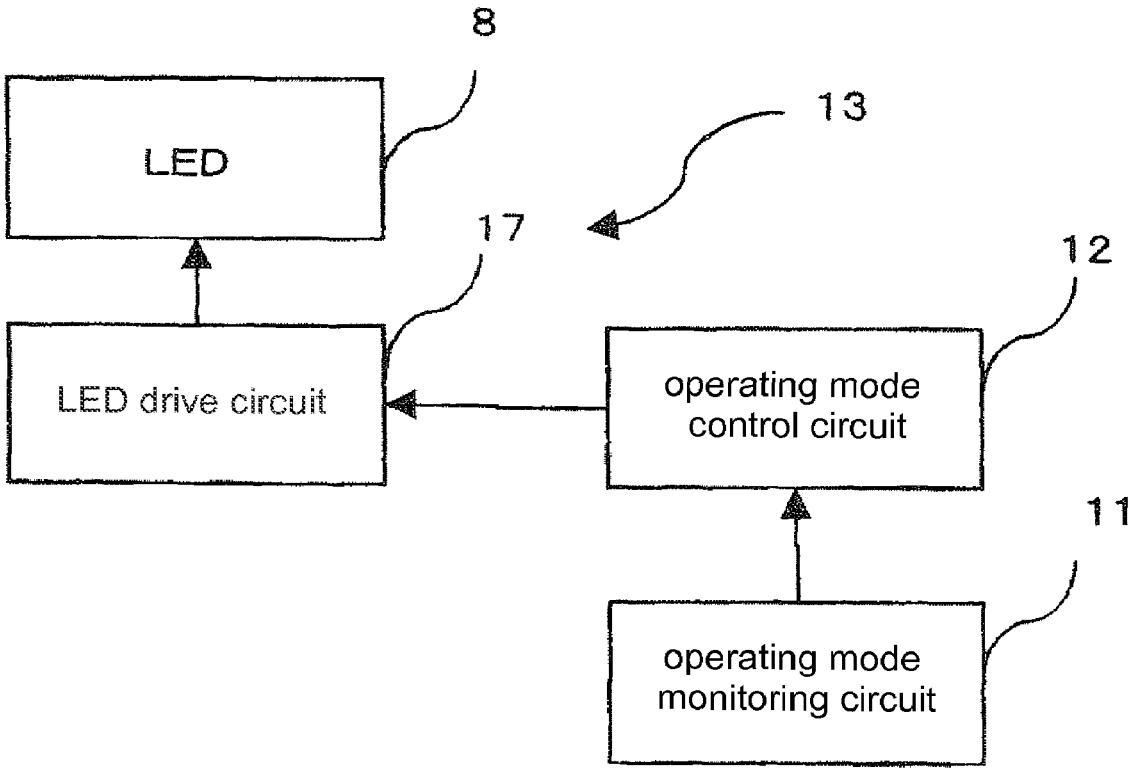
FIG. 5 is a block diagram showing a variant of the operating mode switching control system in the same copier.

Note that, in this embodiment, although two types of LEDs 8*a* and 8*b* with different display colors are used to switch the illumination color between the normal mode and the power saving mode, the present invention is not limited to this and, for instance, a constitution such as shown in FIG. 5 can also be adopted.

That is to say, in FIG. 5, the mode notification means 13 comprises a single LED 8 and an LED drive circuit 17 serving as the illumination drive means for switching the display mode of this LED 8 according to the normal mode and the power saving mode. Then, the LED drive circuit 17 performs control so that the LED 8 is continuously illuminated in the normal mode, while the LED 8 repeatedly flashes at a predetermined interval in the power saving mode.

Thus, in this case as well, an observer can easily distinguish between the normal mode, the power saving mode and the power source off mode, based on the difference in the lighting mode of the LED 8, so that usability is improved compared to the conventional situation. Note that, in this case as well, the light source is not limited to the LED 8, and other light sources such as incandescent lamps can also be used.

In addition, in this embodiment, although descriptions were given for cases where the light sources 8*a*, 8*b* and 8 were used as backlights for the liquid crystal display unit 7 provided on the control panel 4, the present invention is not limited to usage of the light sources as backlights and, for instance, a dedicated light source for mode identification can also be provided on the control panel 4.

In addition, in this embodiment, although descriptions were given using the copier 1 as an image forming device, the present invention is not limited to such a copier and can be applied broadly to printers, facsimile devices, multi-function machines, other image forming devices or the like.

What is claimed is:

1. An image forming device comprising:

a main body;

a sheet receiving tray being configured to receive paper outputted after an image forming process;

an operating mode switching control system being configured to switch the image forming device to a power saving mode from a normal mode upon continuation of a non-processing period for more than a predetermined amount of time in the normal mode allowing the image forming process, the power consumption being reduced in the power saving mode;

a control panel having a liquid crystal display unit and light sources being backlights for the liquid crystal display unit, the liquid crystal display unit having a mode notification device being configured to make a display mode of the light sources of the liquid crystal display unit differ according to the normal mode and the power saving mode, the mode notification device consisting of a first light source being configured to be used in the normal mode, and a second light source being configured to be used in the power saving mode and being configured to consume less power than the first light source, the first light source and the second light source each being an LED, the first and second light sources being backlights for the liquid crystal display unit and having display colors different from one another; and an illumination drive device switching between and driving the illumination of each light source according to the normal mode and the power saving mode.

2. The image forming device according to claim 1, the first light source has a white display color.

3. An image forming device comprising:

a main body;

an operating mode switching control system being configured to switch the image forming device to a power saving mode from a normal mode upon continuation of a non-processing period for more than a predetermined amount of time in the normal mode allowing an image forming process, the power consumption being reduced in the power saving mode; and a control panel having a liquid crystal display unit and a light source being a backlight for the liquid crystal display unit, the liquid crystal display unit having a mode notification device being configured to make a display mode of the light source of the liquid crystal display unit differ according to the normal mode and the power saving mode, the mode notification device having the light source being configured to be continuously illuminated in the normal mode, and being configured to flash repeatedly at a predetermined interval in the power saving mode.

4. An image forming device comprising:

a main body means;

a sheet receiving means for receiving paper outputted after an image forming process;

an operating mode switching control system means for switching the image forming device to a power saving mode from a normal mode upon continuation of a non-processing period for more than a predetermined amount of time in the normal mode allowing an image forming process, the power consumption being reduced in the power saving mode; and control panel means for providing liquid crystal display means, the liquid crystal display means having mode notification means for making a display mode of a light source of the display means differ according to the normal mode and the power saving mode, the mode notification means consisting of a first light source being configured to be used in the normal mode, and a second light source being configured to be used in the power saving mode and being configured to consume less power than the first light source, the first and second light sources being backlights for the liquid crystal display means, and having display colors different from one another; and an illumination drive means switching between and driving the illumination of the each light source according to the normal mode and the power saving mode.

* * * * *